US010813531B2

(12) United States Patent
Hansen et al.

(10) Patent No.: US 10,813,531 B2
(45) **Date of Patent: *Oct. 27, 2020**

(54) DISHWASHER WITH GUIDE RAIL

(71) Applicant: WHIRLPOOL CORPORATION, Benton Harbor, MI (US)

(72) Inventors: Matthew Martin Kenneth Hansen, Saint Joseph, MI (US); Abhinay S. Munje, Maharashtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/879,186

(22) Filed: May 20, 2020

(65) Prior Publication Data

US 2020/0288942 A1 Sep. 17, 2020

Related U.S. Application Data

(63) Continuation of application No. 16/353,552, filed on Mar. 14, 2019, now Pat. No. 10,694,924.

(51) Int. Cl.
*A47L 15/50* (2006.01)

(52) U.S. Cl.
CPC ..... *A47L 15/507* (2013.01)

(58) Field of Classification Search
CPC ..... A47L 15/507; A47B 88/57; A47B 2210/0018
USPC ..... 312/228.1
See application file for complete search history.

(56) References Cited

U.S. PATENT DOCUMENTS

| | | | | |
|---|---|---|---|---|
| 3,280,086 | A | 10/1966 | Nakajima et al. | |
| 5,061,020 | A | 10/1991 | Ulrich | |
| 5,181,782 | A | 1/1993 | Wojcik | |
| 5,242,222 | A | 9/1993 | Michael | |
| 6,244,678 | B1 * | 6/2001 | Dopp | A47B 88/467 312/333 |
| 6,280,086 | B1 * | 8/2001 | Stijns | A47B 88/493 384/18 |
| 7,001,004 | B2 | 2/2006 | Bartloff et al. | |
| 7,455,066 | B2 | 11/2008 | Feddema et al. | |
| 9,192,232 | B2 | 11/2015 | Park et al. | |
| 10,264,944 | B2 * | 4/2019 | Dabal | A47L 15/4246 |
| 2004/0201339 | A1 | 10/2004 | Dickson et al. | |
| 2006/0250058 | A1 | 11/2006 | Stevens et al. | |
| 2019/0261829 | A1 * | 8/2019 | Racs | A47L 15/507 |

FOREIGN PATENT DOCUMENTS

| | | | |
|---|---|---|---|
| CN | 201595804 | U | 10/2010 |
| FR | 2383645 | A1 | 10/1978 |
| WO | 9842232 | A2 | 10/1998 |

* cited by examiner

*Primary Examiner* — Daniel J Troy
*Assistant Examiner* — Timothy M Ayres
(74) *Attorney, Agent, or Firm* — McGarry Bair PC

(57) ABSTRACT

A dishwasher with at least one guide rail. The guide rail can slidably couple a dish rack to a tub, where the tub defines at least a portion of a treating chamber. The dish rack can carry at least one wheel assembly that includes at least one wheel. The wheel can be contained in a wheel channel of the wheel assembly. The wheel channel can in part be defined by walls of the guide rail. A track closure can rotatably couple to the guide rail for the selective removal of the dish rack from the guide rail.

20 Claims, 7 Drawing Sheets

DISHWASHER WITH GUIDE RAIL

CROSS REFERENCE TO RELATED APPLICATIONS

This application is a continuation of U.S. patent application Ser. No. 16/353,552, filed Mar. 14, 2019, now U.S. Pat. No. 10,694,924, issued Jun. 30, 2020, all of which is hereby incorporated by reference in its entirety.

BACKGROUND

Contemporary automatic dishwashers for use in a typical household include a tub, where at least upper and lower racks or baskets for supporting soiled dishes are located within the tub. A track closure can be provided for one or more of the dish racks to prevent unintentional removal from the tub. The track closure can couple to a guide rail and rotate from an open position to a closed position.

BRIEF DESCRIPTION

In one aspect the present disclosure relates to a dishwasher including a tub defining at least a portion of a treating chamber with an open face, a dish rack sized to fit through the open face, at least one wheel assembly carried by the dish rack and having at least one wheel, at least one guide rail coupled to the tub and having a track having an upper wall and a lower wall spaced from the upper wall with pin holes, a side wall connecting the upper wall and lower wall, with the upper wall, the lower wall, and the side wall defining a wheel channel receiving the wheel, and the track having an open end, and a U-shaped track closure having an upper finger and a lower finger spaced from the upper finger and connected to the upper finger by a bight on a first side and open on a second side, at least one rib protruding from the bight and adapted to form a wheel stop, wherein when the U-shaped track closure is operably coupled to the open end of the track the at least one rib extends into the wheel channel.

DETAILED DESCRIPTION

Figure 1:
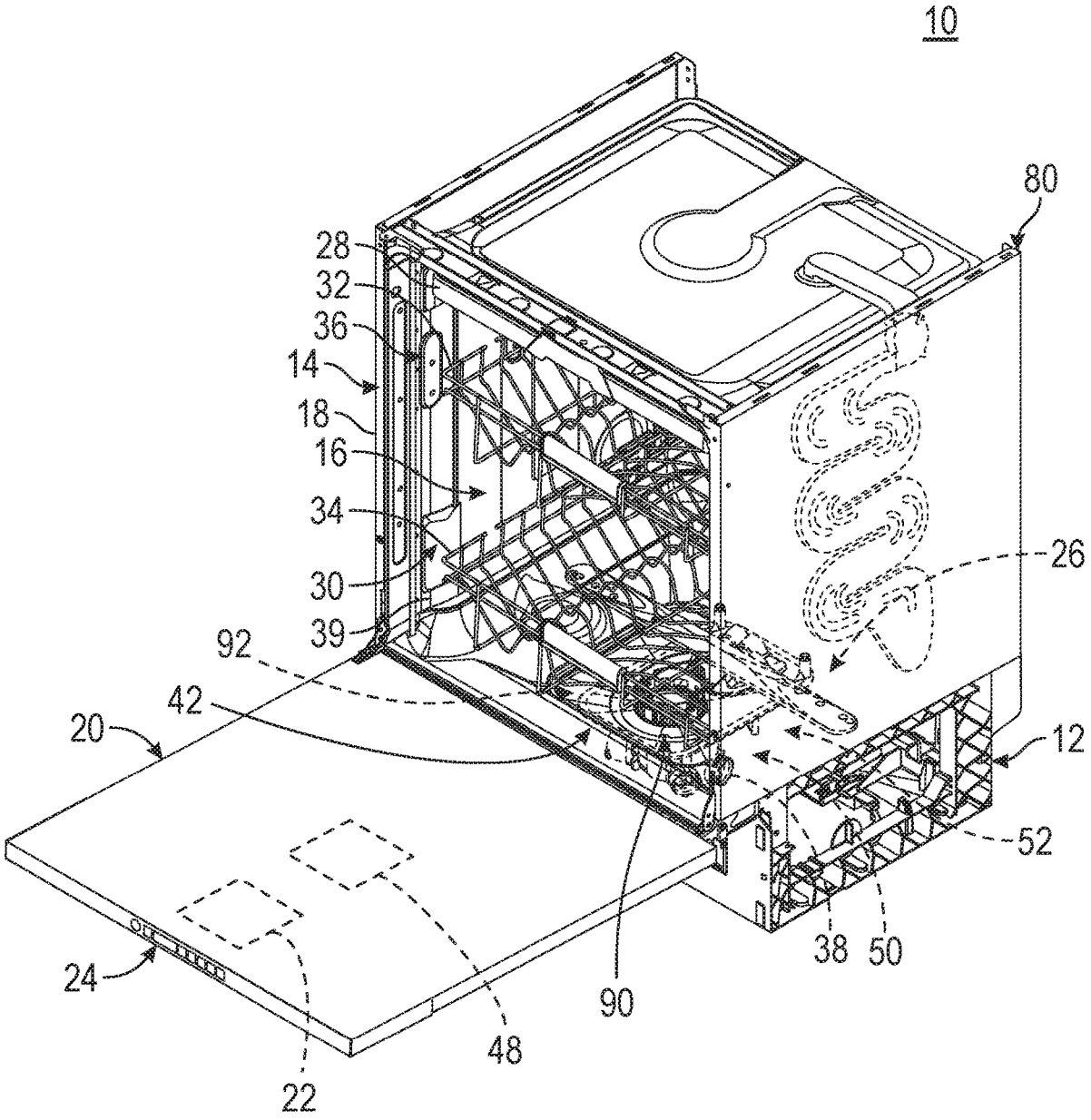
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported a open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include spray system 26 dish holding system 30, recirculation system 42, water supply system 50, drain system 52, drying system 80, heating system 90, and filter system 92. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish rack 32 and lower dish rack 34, commonly referred to as "dish racks", which are located within the treating chamber 16. The upper dish racks 32 and the lower dish rack 34 are typically sized and mounted for slidable movement in and out of the treating chamber 16 through the open face 18 of the tub 14 for ease of loading and unloading. At least one drawer guide, slide, or guide rail 36 are typically used to slideably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish racks can also be provided. One such dedicated dish rack is a third level rack 28 located above the upper dish rack 32. Like the upper dish rack 32, the third level rack 28 is slideably mounted to the tub 14 with the at least one drawer guide, slide, or guide rail 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16 via the at least one guide rail 36.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
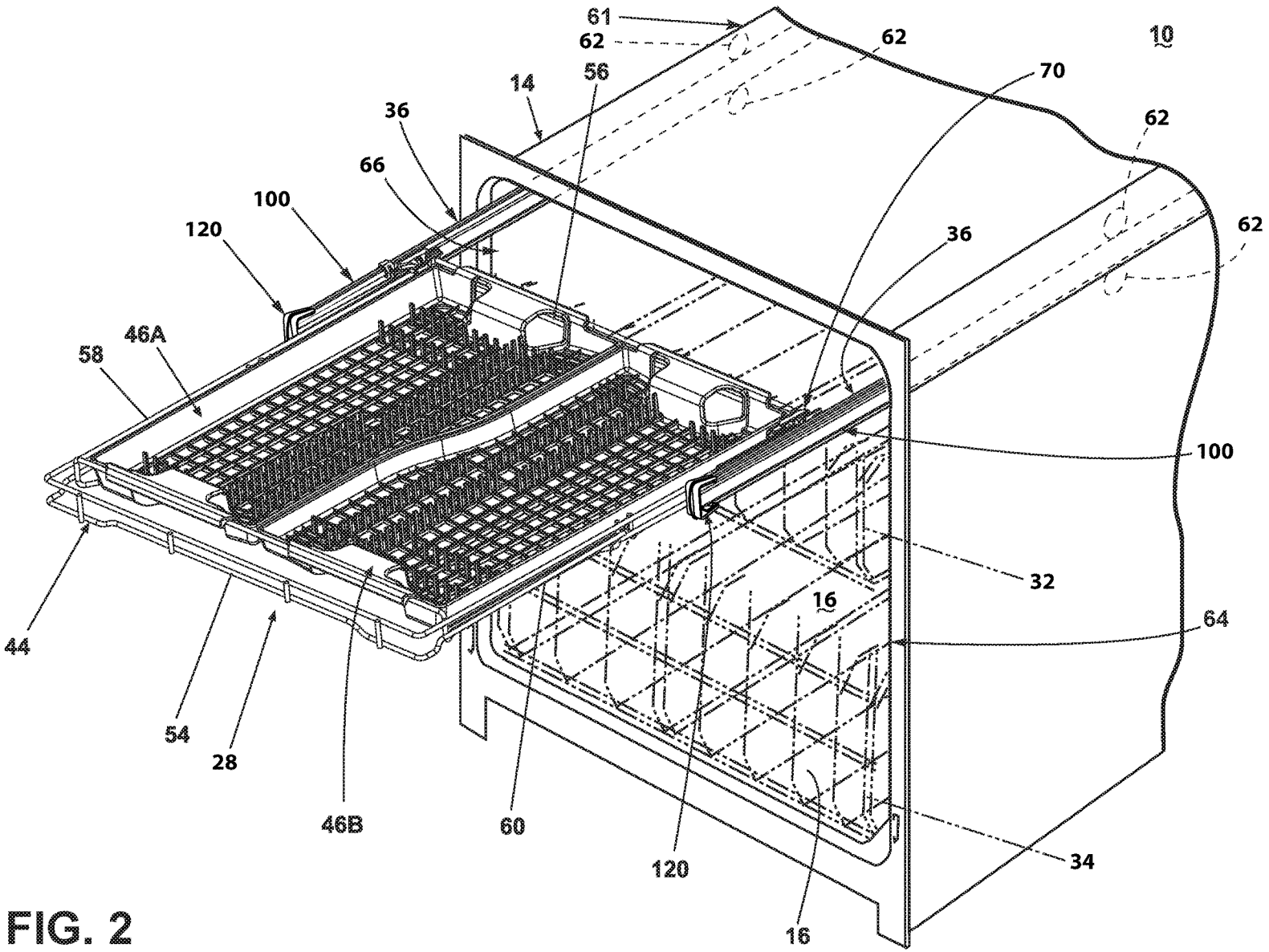
FIG. 2 is a perspective view of the dishwasher of FIG. 1 with a third level rack according to one aspect of the disclosure slid exteriorly from a tub via at least one guide rail.

FIG. 2 illustrates the third level rack 28 slideably removed from the treating chamber 16 of the dishwasher 10 via the open face 18 of the tub 14. The third level rack 28 includes spaced front and rear sides 54, 56 connected by opposing sides 58, 60. A frame 44 can be defined by the front, rear, and opposing sides 54, 56, 58, 60. Optionally, removable basket elements 46A, 46B can be supported by the frame 44, where the removable basket elements 46A, 46B can hold several types of utensils having various sizes and shapes.

The guide rail 36 can be located on each of the corresponding sides or opposing sides 58, 60 and couple the opposing sides 58, 60 to the tub 14. The guide rail 36 can have one segment or multiple segments, which can be slideably coupled together, such as by rollers or bearings. A wheel assembly 70 slideably mounts the guide rail 36 to the opposing side 58, 60. Another wheel assembly 61 slideably mounts the guide rail 36 to the tub 14. The wheel assembly 61 comprises a pair of wheels 62 mounted in spaced relation to the tub 14, with the space receiving the guide rail 36, resulting in the wheels 62 arranged on each opposing side 64, 66, of the tub 14. While the guide rails 36 in combination with the wheel assemblies 61, 70 are shown slideably mounting the third level rack 28 to the tub 14, they can be used to slideably mount any of the other racks to the tub 14.

Figure 3:
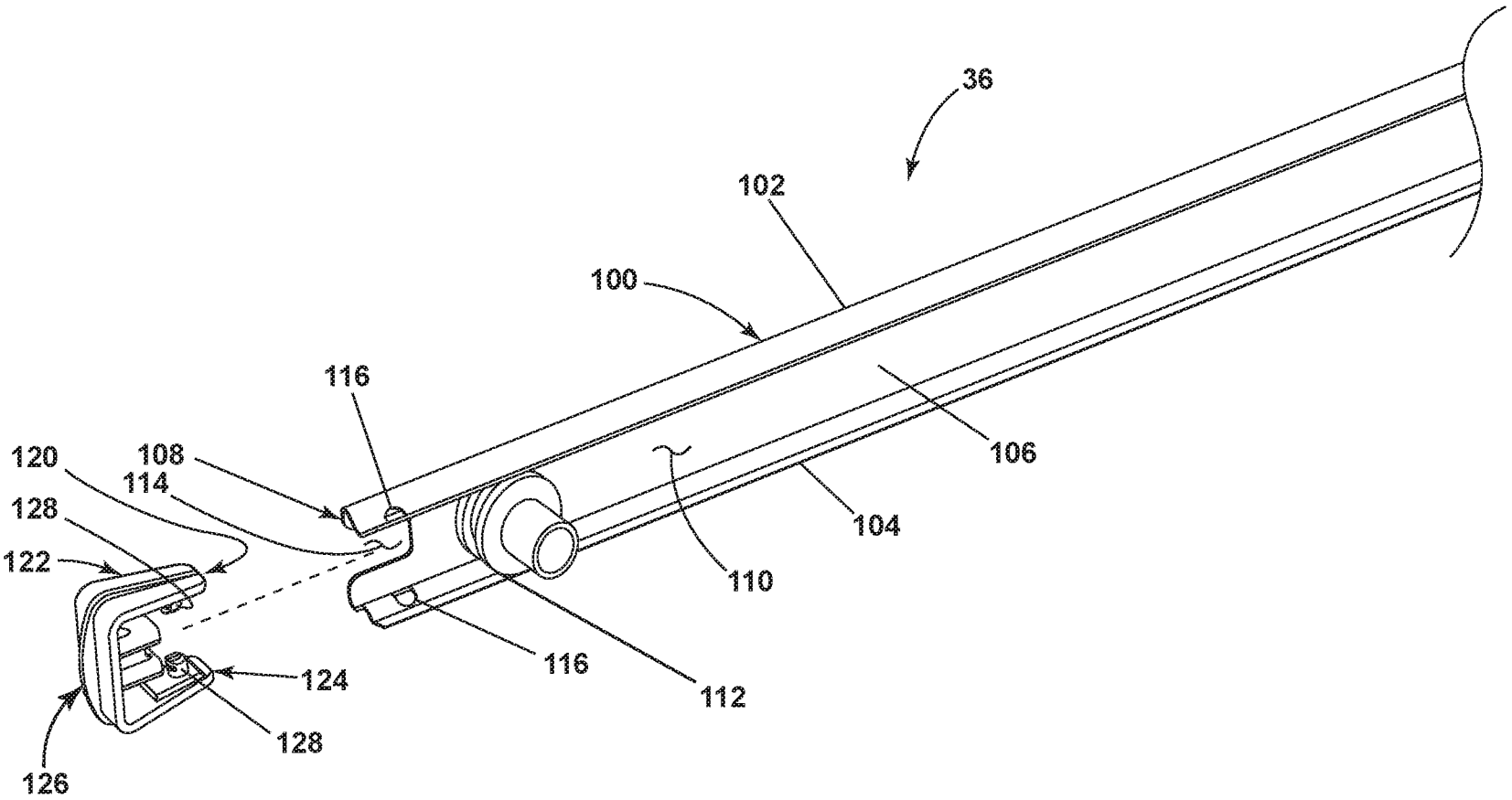
FIG. 3 is an exploded view of the at least one guide rail and track closure of FIG. 2.

FIG. 3 is an exploded view of the guide rail 36. The guide rail 36 can include a track 100 and a closure 120. The track 100 can include an upper wall 102 spaced from a lower wall 104 connected by a generally vertical side wall or middle wall 106 with open end 108. A wheel channel 110 can be at least partially defined by the upper wall 102, the lower wall 104, and the middle wall 106. By way of non-limiting example, at least one wheel 112 can be received in the wheel channel 110.

An opening or notch 114 is provided in a portion of the open end 108 and extends into a portion of the middle wall 106.

Pin holes 116 are located in the in upper wall 102 and the lower wall 104 and can be adjacent to the notch 114. While only two pin holes 116 are illustrated, it is contemplated that any number of pin holes can be present in the track 100.

A track closure 120 can include an upper finger 122 spaced from a lower finger 124. A bight 126 can connect the upper finger 122 to the lower finger 124. The upper and lower fingers 122, 124 can further include pivot pins 128. The pivot pins 128 can pass through the pin holes 116, to pivotally mount the track closure 120 to the track 100 to selectively block the open end 108.

Figure 4:
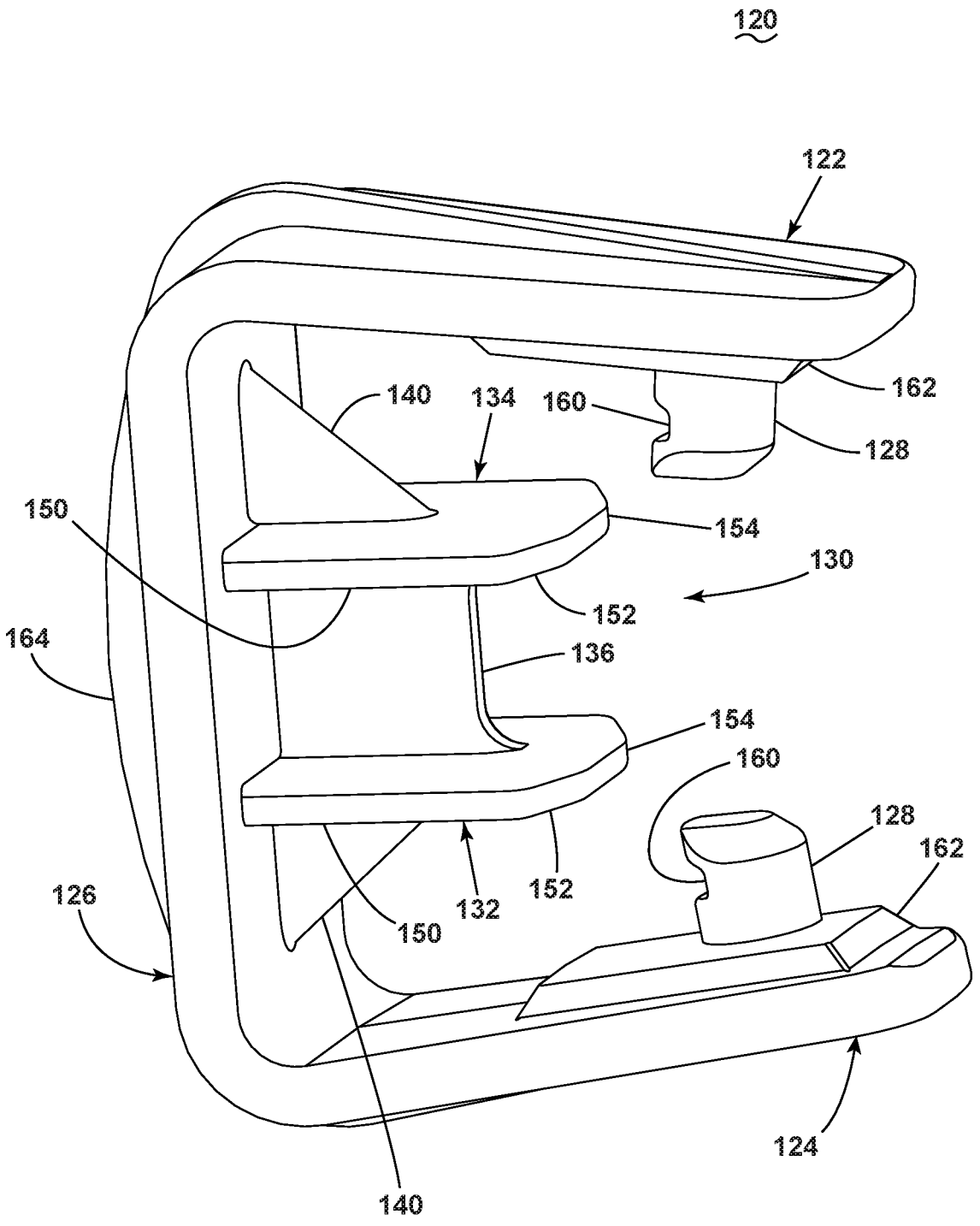
FIG. 4 is an enlarged view of the track closure of FIG. 3.

FIG. 4 further is an enlarged view of the track closure 120 to better illustrates structures not easily seen in FIG. 3. As seen in FIG. 4, a wheel stop 130 extends from the bight 126. The wheel stop 130 includes at least one rib protruding from the bight 126. By way of a non-limiting example, the wheel stop 130 illustrated in FIG. 4 includes a first rib 132 and a second rib 134. While the first and second ribs 132, 134 are illustrated as generally parallel to each other and orthogonal to the bight 126, it is contemplated that the first and second ribs 132, 134 can protrude from the bight 126 in the direction of the pivot pins 128 at a variety of angles relative to the bight 126. It is further contemplated that the first rib 132 and the second rib 134 can extend the same distance or different distances from the bight 126 toward the pivot pins 128.

The first rib 132 can be spaced from the second rib 134. A rib support structure 136 in the space between the first and second ribs 132, 134 can couple the first rib 132 and the second rib 134. Optionally, the rib support structure 136 can couple the first rib 132, the second rib 134, and the bight 126. It is contemplated that the rib support structure 136 can be a variety of shapes and thicknesses to provide support to the first rib 132, the second rib 134, or the bight 126. Gussets 140 can further couple to the first rib 132 or the second rib 134 to the bight 126. Additionally or alternatively, the gussets 140 can couple the first rib 132 or the second rib 134 to an upper finger 122 or a lower finger 124.

The first rib 132 can include a base portion 150, a chamfer 152, and a nose 154. The base portion 150 couples to and extends from the bight 126 to the chamfer 152, which extends between the base portion 150 and the nose 154. The second rib 134, being optionally similar to the first rib 132, can also include the base portion 150, the chamfer 152, and the nose 154.

A groove 160 can be located on a portion of the pivot pins 128. The groove 160 can be on the portion of the pivot pins 128 closest to or facing the bight 126. A pin base 162 couples the pivot pins 128 to the upper or lower fingers 122, 124. It is contemplated that the pin base 162 can interface with the upper or lower walls 102, 104 of the track 100 to encourage or discourage rotation of the track closure 120.

A finger tab 164 extends from a portion of the bight 126 opposite the wheel stop 130. It is contemplated that the finger tab 164 can be grasped between a user's fingers for pivotally moving the track closure 120. Additionally or alternatively, the finger tab 164 can be used in the manufacturing or installation of the track closure 120.

Figure 5:
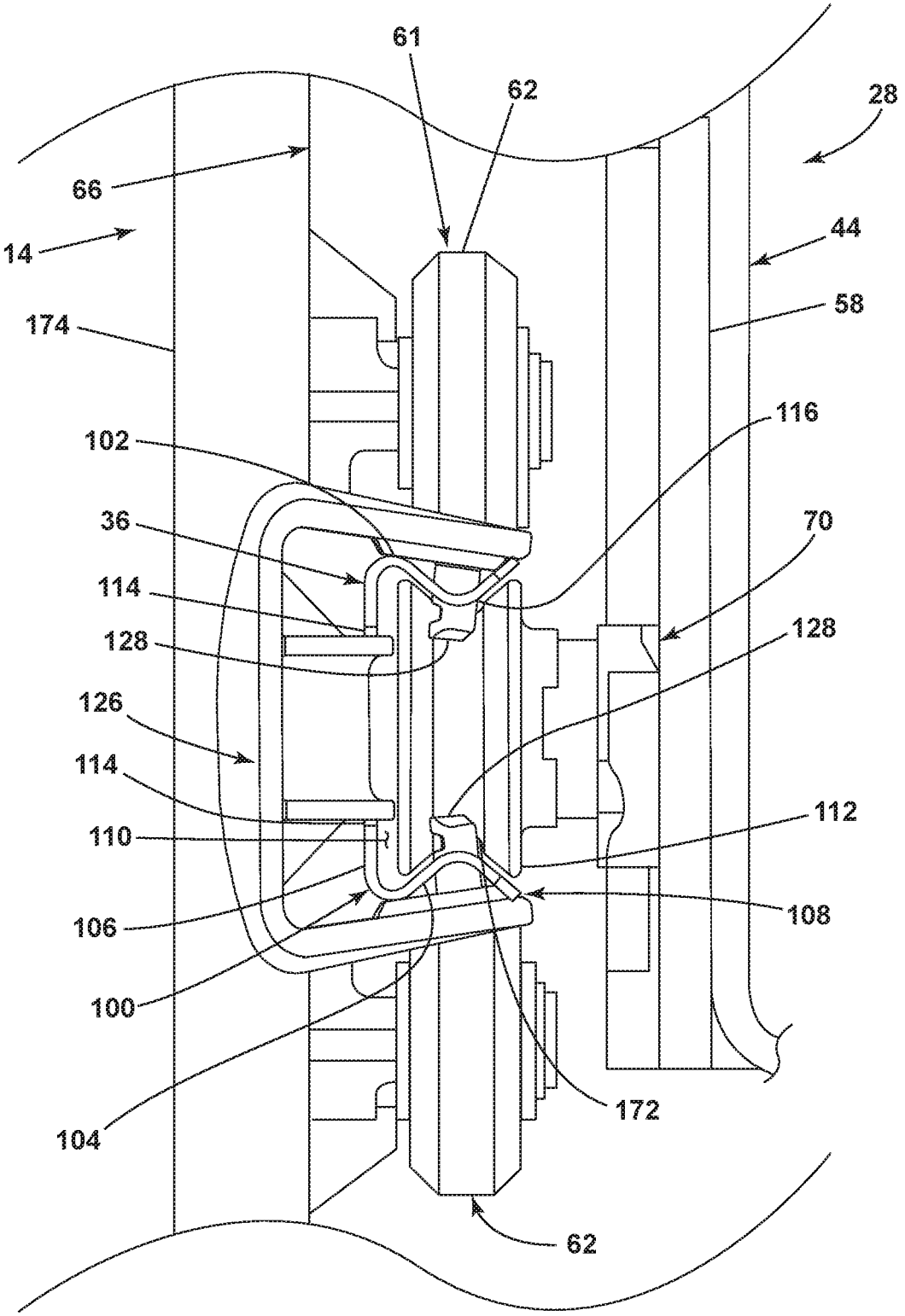
FIG. 5 is a front view of a portion of the dishrack and guide rail of FIG. 2 with the track closure shown in an opened position.

FIG. 5 illustrates the third level rack 28 coupled to the tub 14 via the guide rail 36. The at least one wheel 62 is illustrated as coupling to the opposing side 66 of the tub 14. It is contemplated that the opposing sides 64, 66 of the tub 14 are similar, such that the opposing side 64 also carries at least one wheel 62. This results in the tub 14 having at least one wheel 62 arranged on each of the opposing sides 64, 66.

The at least one wheel assembly 70 that is carried by the third level rack 28 can include the wheel 112 with a wheel trough 172. The at least one wheel assembly 70 couples to the opposing side 58 of the third level rack 28. It is contemplated that the opposing sides 58, 60 of the third level rack 28 are similar, such that the opposing side 60 also carries the wheel assembly 70. Therefore the wheel assembly 70, with the wheel 112, can be arranged along each of the opposing sides 58, 60 of the third level rack 28, such that cooperating pairs of first and second wheels 62, 112 are located along each side of the third level rack 28. The guide rail 36 couples each cooperating pairs of the first and second wheels 62, 112.

The track closure 120 can pivot while coupled to the track 100 via pivot pins 128 that pass through the pin holes 116. At least a portion of one of the pivot pins 128 extends into the wheel channel 110. This connection permits the track closure 120 to pivot between a closed position, where the bight 126 blocks the open end 108, and an opened position where the bight 126 unblocks the open end 108. The middle wall 106 of the track 100 with the opening or notch 114 receives the wheel stop 130 as the track closure 120 is moved between the closed position and opened position.

As illustrated in FIG. 5, the track closure 120 is illustrated in the open position as the notch 114 in the track 100 accommodates the wheel stop 130. The open position is further defined by the track closure 120 positioned such that the wheel 112 can pass through the open end 108, allowing a user to remove the third level rack 28 from the tub 14 and the guide rail 36. In the open position, at least a portion of the bight 126 can extend beyond the opposing side 66 of the tub 14. That is, at least a portion of the bight 126 can extend outside the tub 14 and overlap a portion of a gasket 174. This overlap can cause at least a portion of the bight 126 to contact with the gasket 174 if the third level rack 28 is restored within the tub 14 as illustrated in FIG. 1. The contact between the gasket 174 and the bight 126 can cause the track closure 120 to rotate.

Figure 6:
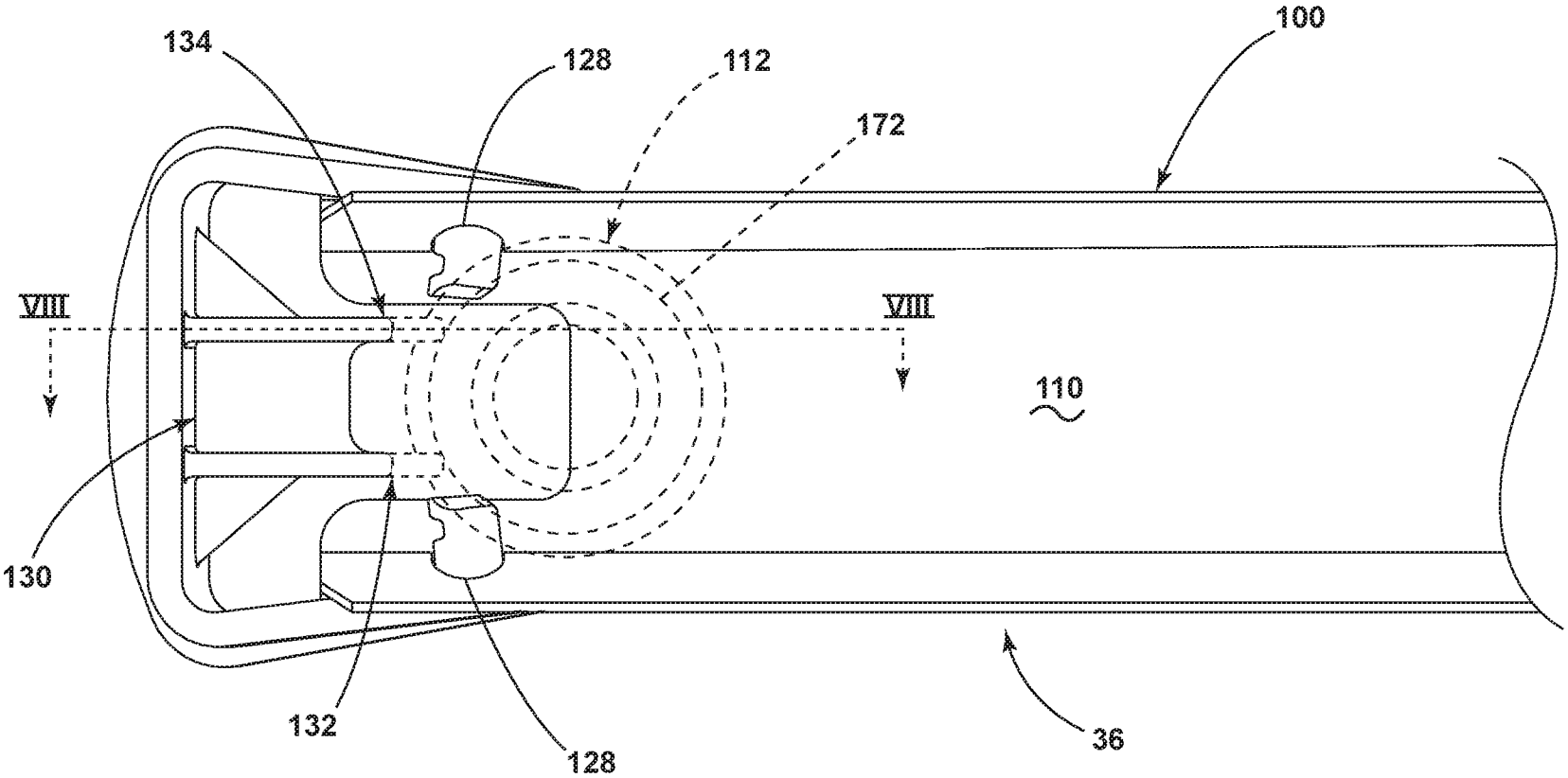
FIG. 6 is a side view of the guide rail of FIG. 3 with the track closure shown in a closed position.

FIG. 6 illustrates the track closure 120 in the closed position. The closed position can be, at least in part, defined as the alignment of the bight 126 and the open end 108, so that the bight 126 blocks the open end 108. In the closed position, the wheel stop 130 extends into the wheel channel 110 a sufficient distance to prevent the wheel 112 from displacing the pivot pins 128 to the point the wheel 112 is released from the track 100. It is contemplated that the wheel stop 130, when the track closure 120 is in the closed position, extends into the wheel channel 110 a sufficient distance, by way of non-limiting example at least 5% of the diameter of the wheel, as to prevent the wheel 112 from contacting the pivot pins 128.

The wheel 112 can receive at least a portion of the wheel stop 130 within the wheel trough 172. It is contemplated that at least a portion of the first rib 132 or the second rib 134 is received by the wheel 112. It is further contemplated that at least a portion of the chamfer 152 and the nose 154 of the first rib 132 or the second rib 134 is received by the wheel trough 172.

Figure 8:
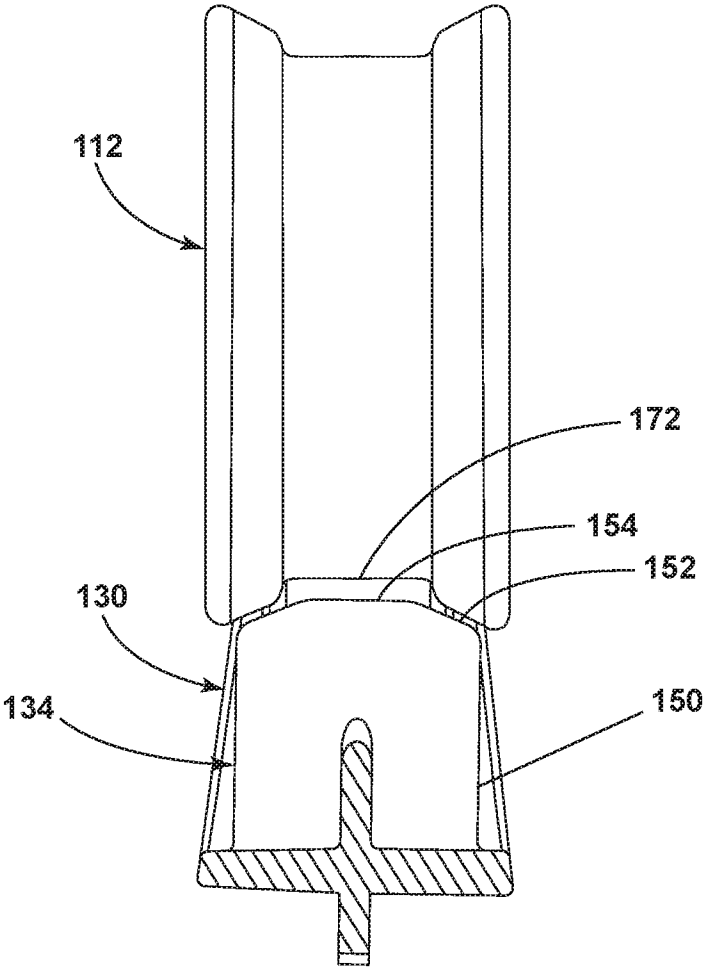
FIG. 8 is top down view of the cross section of the track closure of FIG. 6 in the closed position to illustrate a self-aligning feature of the track closure.
Figure 7:
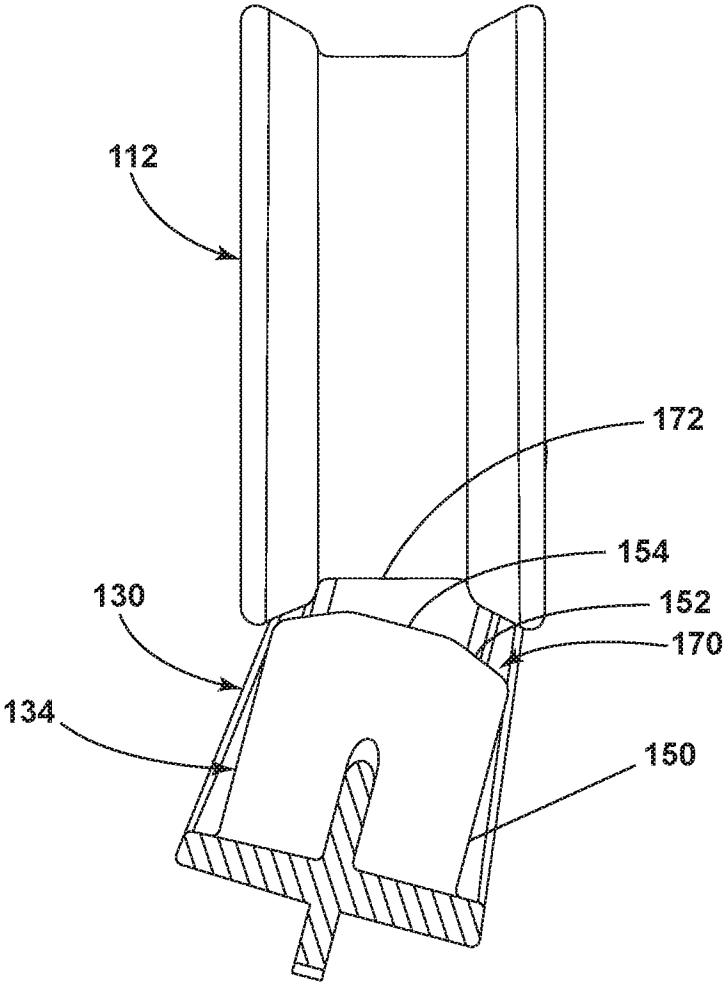
FIG. 7 is a top down view of the track closure of FIG. 6 in an out of alignment position between opened and closed according to one aspect of the disclosure.

If the wheel stop 130 of the track closure 120 is not completely pivoted to the closed position, as in FIG. 7, its structure provides a self-aligning feature 170. The self-aligning feature 170 can be the chamfer 152. As the third level rack 28 is pulled out of the tub 14 and the wheel 112 is brought into contact with the wheel stop 130 (FIG. 7), the continued outward movement of the third level rack 28 will cause the wheel 112 to abut the chamfer 152 and pivot the track closure 120 into the closed position as illustrated in FIG. 8. Thus, if a user accidentally doesn't close the track closure 120, it will self-aligning or self-close as the third level rack 28 is pulled out.

The chamfer 152 is illustrated, by way of non-limiting example, as having a smooth, sloped surface. The shape of the chamfer 152 of the first or second rib 132, 134 can be contoured to any shape that biases the track closure 120 to the closed position when pressure is applied to the chamfer 152 by the wheel 112.

FIG. 8 illustrates a cross section of a portion of the track closure 120 along the second rib 134 when the track closure 120 is in the closed position. Further illustrated, by way of non-limiting example, is a portion of the chamfer 152 and nose 154 of the second rib 134 received by the wheel trough 172 of the wheel 112.

In operation, a user can pivot the track closure 120 can between an opened position and a closed position. In the opened position, the wheel 112 of the third level rack 28 can pass through the open end 108 of the track 100 for removal of the third level rack 28 from the guide rail 36 and tub 14.

The track closure 120 in the opened position also allow for the replacement of the third level rack 28 into the guide rail 36 and tub 14. Once the wheel 112 is contained inside the guide rail 36 past the pivot pins 128, the track closure 120 can be rotated by the use to the closed position.

If the user fails to pivot the track closure 120 to the closed position, at least a portion of the track closure 120 will contact the gasket 174 as the third level rack 28 is replaced entirely in the tub 14. This will rotate the track closure 120 to a position between opened and closed. When the user again extends the third level rack 28 from the tub 14 using the guide rail 36, the wheel 112 will contact the self-aligning feature 170 of the track closure 120. The track closure 120 will then pivot or rotate to the closed position, preventing the third level rack 28 and the wheel 112 from uncoupling from the guide rail 36. The chamfer 152 can function as a self-aligning feature 170.

While the present disclosure has illustrated the guide rail 36 and the track closure 120 coupled to the third level rack 28, it is contemplated that the same or similar guide rails with the track closure 120 can be used on any dish rack in the dishwasher 10, such as, but not limited to, the upper dish rack 32 and the lower dish rack 34.

It is further contemplated that the track closure 120 can be used in a guide rail that includes two tracks arranged in a back-to-back relationship to form a first track and a second track, with at least one of the first and second tracks having the pin holes.

Benefits to the current invention include a self-aligning feature of a track closure. If a user forgets to pivot the track closure to the closed position, the dish rack will not unintentionally leave the guide rail, as the self-aligning feature (s) biases the track closure to a closed position. When the dish rack is restored to the guide rail and reinserted into the tub, at least a portion of the track closure contacts the tub gasket, pivoting the track closure to a position between opened and closed. Further, when the dish rack is extended again from the tub using the guide rail, wheel pressure from the wheel contained in the guide rail on the chamfer portion of the wheel stop rotates the track closure from the position between opened and closed to the closed position.

Further, the wheel stop, when the track is in the closed position or between the opened and closed position, extends into the wheel channel to keep the one or more wheels connected to the dish rack from applying too much force against the pivot pins used to rotate the track closure. That is, the wheel stop extends into the channel a sufficient distance to prevent the wheel contained in the wheel channel from forcing the pivot pins out of the pin holes, thus preventing the wheel from passing the pivot pins and unintentionally detaching from the guide rail.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher, comprising:

a tub defining at least a portion of a treating chamber with an open face;

a dish rack sized to fit through the open face;

at least one wheel assembly carried by the dish rack and having at least one wheel;

at least one guide rail coupled to the tub and having a track having an upper wall and a lower wall spaced from the upper wall, a side wall connecting the upper wall and lower wall, with the upper wall, the lower wall, and the side wall defining a wheel channel receiving the wheel, and the track having an open end; and a U-shaped track closure having an upper finger and a lower finger spaced from the upper finger and connected to the upper finger by a bight on a first side and open on a second side, a first rib protruding from the bight and a second rib is spaced from the first rib by a first space protruding from the bight, the first rib and second rib adapted to form a wheel stop and a first gusset coupling the first rib to the bight, wherein when the U-shaped track closure is operably coupled to the open end of the track the first rib extends into the wheel channel.

2. The dishwasher of claim 1 wherein the first rib is generally orthogonal to the bight.

3. The dishwasher of claim 1 wherein the first rib and the second rib are generally parallel.

4. The dishwasher of claim 3 wherein the first rib and the second rib are orthogonal to the bight.

5. The dishwasher of claim 1 wherein the first rib and the second rib extend a same length from the bight.

6. The dishwasher of claim 1, further comprising a support structure coupling the first rib and the second rib and located within the first space.

7. The dishwasher of claim 6 wherein the support structure further couples the bight.

8. The dishwasher of claim 1, further comprising a second gusset coupling the second rib to the bight.

9. The dishwasher of claim 1 wherein the first gusset further couples to the upper finger.

10. The dishwasher of claim 1 wherein at least one of the first rib or the second rib comprises a base portion extending from the bight and a nose located at a distal end away from the bight.

11. The dishwasher of claim 10 wherein the at least one of the first rib or the second rib further comprises a chamfer extending between the base portion and the nose.

12. The dishwasher of claim 1, further comprising a first pin base extending from the upper finger and a second pin base extending from the lower finger.

13. The dishwasher of claim 12 wherein at least one of the first pin base and the second pin base interface with the at least one of the upper wall and the lower wall of the track.

14. The dishwasher of claim 12, further comprising a first pivot pin extending from the first pin base and a second pivot pin extending from the second pin base, the first pivot pin and the second pivot pin receivable within pin holes in the upper wall and the lower wall, respectively.

15. The dishwasher of claim 14 wherein the at least one of the first rib or the second rib extends into the wheel channel a sufficient distance to prevent the wheel from pushing past the first pivot pin and the second pivot pin.

16. The dishwasher of claim 1, further comprising a finger tab extending from the bight opposite the first rib.

17. The dishwasher of claim 1 wherein the U-shaped track closure further comprises a self-aligning feature.

18. The dishwasher of claim 17 wherein the self-aligning feature is a chamfer that extends between a base portion and a nose of the first rib.

19. A dishwasher, comprising:

a tub defining at least a portion of a treating chamber with an open face;

a dish rack sized to fit through the open face;

at least one wheel assembly carried by the dish rack and having at least one wheel;

at least one guide rail coupled to the tub and having a track having an upper wall and a lower wall spaced from the upper wall, a side wall connecting the upper wall and lower wall, with the upper wall, the lower wall, and the side wall defining a wheel channel receiving the wheel, and the track having an open end; and a U-shaped track closure having an upper finger and a lower finger spaced from the upper finger and connected to the upper finger by a bight on a first side and open on a second side, a first rib protruding from the bight and adapted to form a wheel stop and a first gusset coupling the first rib to the bight, wherein when the U-shaped track closure is operably coupled to the open end of the track the first rib extends into the wheel channel.

20. A dishwasher, comprising:

a tub defining at least a portion of a treating chamber with an open face;

a dish rack sized to fit through the open face;

at least one wheel assembly carried by the dish rack and having at least one wheel;

at least one guide rail coupled to the tub and having a track having an upper wall and a lower wall spaced from the upper wall, a side wall connecting the upper wall and lower wall, with the upper wall, the lower wall, and the side wall defining a wheel channel receiving the wheel, and the track having an open end; and a track closure having an upper finger and a lower finger spaced from the upper finger and connected to the upper finger by a bight on a first side and open on a second side, at least one rib protruding from the bight and adapted to form a wheel stop and a first gusset coupling the at least one rib to the bight, wherein when the track closure is operably coupled to the open end of the track the at least one rib extends into the wheel channel.

* * * * *